United States Patent [19]

Frano

[11] Patent Number: 5,027,481

[45] Date of Patent: Jul. 2, 1991

[54] SHELL BUCKLE

[75] Inventor: Francis G. Frano, Hoffman Estates, Ill.

[73] Assignee: Illinois Tool Works, Glenview, Ill.

[21] Appl. No.: 607,814

[22] Filed: Nov. 1, 1990

[51] Int. Cl.[5] ..... A44B 11/26

[52] U.S. Cl. ..... 24/606; 24/616; 24/635

[58] Field of Search ..... 24/614, 615, 616, 625, 24/606, 607, 633, 634, 635

[56] References Cited

U.S. PATENT DOCUMENTS

| | | | |
|---|---|---|---|
| 3,430,306 | 3/1969 | Tareau | 24/625 X |
| 4,831,694 | 5/1989 | Kong | 24/635 X |
| 4,987,661 | 1/1991 | Kasai | 24/633 X |

FOREIGN PATENT DOCUMENTS

| | | | |
|---|---|---|---|
| 2226129 | 11/1974 | France | 24/616 |
| 2451175 | 10/1980 | France | 24/616 |
| 2138879 | 10/1984 | United Kingdom | 24/634 |
| 2156423 | 10/1985 | United Kingdom . | |

*Primary Examiner*—James R. Brittain

[57] ABSTRACT

A shell buckle for releasably securing together a pair of ends of a belt, strap or the like includes a shell buckle latch member and a shell buckle body member. The latch member has a pair of opposed resilient arms which are movable toward and away from each other. The body member includes a central body portion which has a pair of resilient arch members extending from the opposite sides thereof so as to form a C-shaped section. The resilient arms are receivable in the central body portion and are releasably interengaging with means of the body member to connect the latch and body members together. The resilient arch members include opposite side guard members which are movable inwardly relative to each other with a curling action to form the C-shaped section with a smaller radius to cause inward movement of the resilient arms on the latch member to disengage the latch member from the body member.

16 Claims, 2 Drawing Sheets

10
12
16
48a
44
4
50
48b
18
14
48a
46
50
48b
4

2°
12
16
48a
44
50
48b
28
A
30
22
20
48a
46
50
48b
A
80
82
18
68
72
66
14
64
70
74
80
82

B
102
50
16
42
62a
18
C
12
14
80
74
82
22
46
76
50
C
104
B

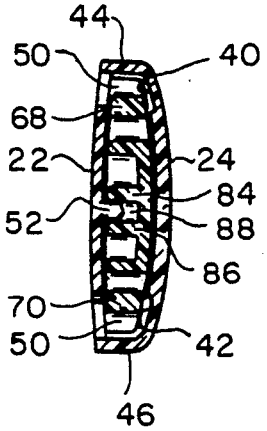
FIG.4
FIG. 5
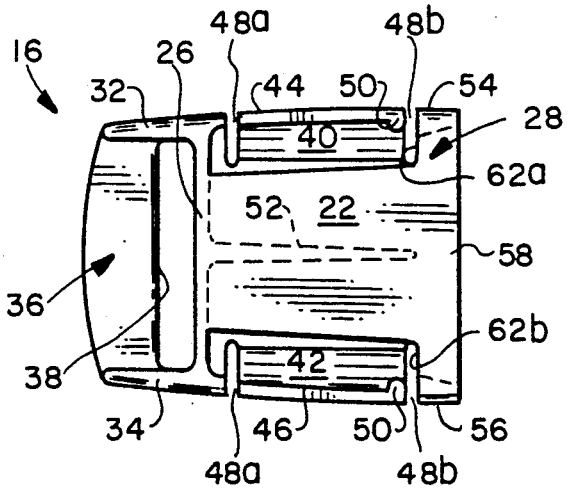
FIG. 7
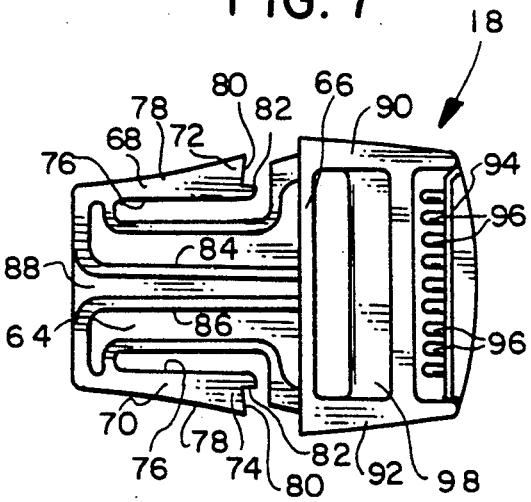
FIG.6
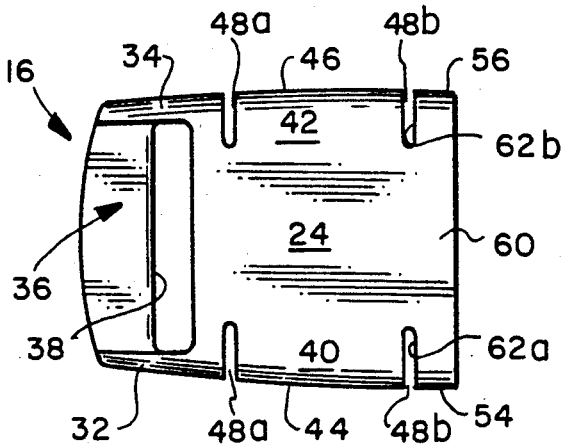
FIG.8
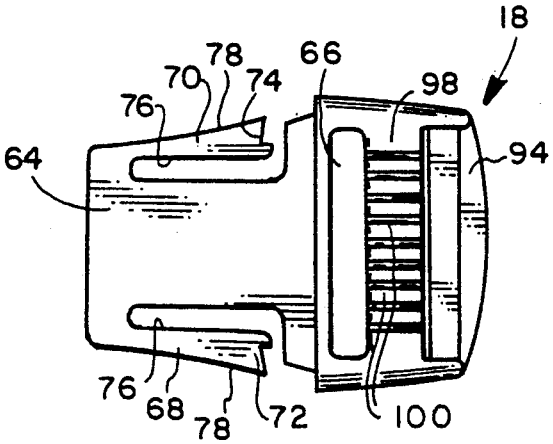

SHELL BUCKLE

BACKGROUND OF THE INVENTION

This invention relates generally to fastener devices and more particularly, it relates to a shell buckle formed of a shell buckle body member and a shell buckle latch member which are capable of being releasably interlocked together and includes a pair of resilient arch members extending from the sides of a central portion of the body member so as to form a C-shaped section for facilitating a quick-release of the latch member from the body member.

The present invention has numerous applications and as a specific example but not intended to serve as a limitation upon its scope or teachings, the shell buckle of this invention may be utilized for connecting the straps or belts of a life-jacket, backpack, and the like where it is desired to releasably secure the ends of the strap or belt together. There are known heretofore in the prior art of various types of such buckles For example, British Patent No. 1,146,568 discloses a connecting device which is comprised of a female member and a male member. The female member includes a pair of slots extending longitudinally of its body and a pair of flexible arms also extending longitudinally of its body. The male member includes a pair of flexible tongues extending away from and longitudinally of its body portion. The tongues expand into slots so as to prevent retraction of the male member until the flexible arms of the female member are pushed to urge inwardly the tongues of the male member.

In British patent application No. 2,138,879A, there is disclosed a buckle comprising of separable cooperating receptacle and clasp members each having a pair of opposed resilient arms. The arms on the receptacle are movable inwardly relative to each other so as to cause inward movement of the arms on the clasp member, thereby uncoupling the clasp member from the receptacle member.

In British patent application No. 2,140,859A, there is disclosed a buckle which comprises a male member having a pair of resilient flexible legs and a female member having a socket portion. The socket portion has a pair of side walls defining therebetween a slot for receiving the legs. The socket portion includes a pair of cantilevered arms disposed inwardly of the side walls and resiliently flexible therebetween. The arms are resiliently flexible toward each other to effect disengagement of the legs and the side walls.

Further, British Patent No. 2,156,423 discloses a plug-in latch device comprised of a male member having a latch arm extending longitudinally from its base and presenting a retaining head, and a female member having a resiliently deflectable latch release element joined to both ends of its housing. An intermediate part of the length of the latch release element is deflectable to force the retaining head out of abutment with a retaining shoulder formed on the female member, thereby permitting withdrawal of the male member from the female member.

Finally, in French Patent No. 2,451,175 there is taught a buckle for joining two strap ends which includes a male piece having a pair of resilient tongues projecting from opposed edges and a female piece having two hollows corresponding with the faces of the tongues on the male piece. The female piece further includes a pair of tongues partially covering each hollow for causing suppression of the corresponding tongues on the male piece so as to separate the two pieces.

However, none of the prior art discussed above teach a shell buckle having a shell buckle body member and a shell buckle latch member like that of the present invention which includes a pair of resilient arch members extending from the sides of the central portion of the shell buckle body member so as to form a C-shaped section for facilitating a quick-release of the latch member from the body member.

SUMMARY OF THE INVENTION

Accordingly, it is a general object of the present invention to provide an improved shell buckle which is relatively simple in its construction and utilizes a lesser amount of material so as to reduce manufacturing and assembly costs.

It is an object of the present invention to provide an improved shell buckle which is fabricated from a resilient plastic material so as to be resistant to corrosion and has high reliability during use.

It is another object of the present invention to provide an improved shell buckle formed of a shell buckle body member and a shell buckle latch member which are capable of being releasably interlocked together, the body member having a pair of resilient arch members extending from the sides of a central portion thereof so as to form a C-shaped section for facilitating a quick-release of the latch member from the body member.

In accordance with these aims and objectives, the present invention is concerned with the provision of a shell buckle which includes a shell buckle body member, and a shell buckle latch member which are capable of being releasably interlocked together. The shell buckle body member is formed of an end wall, a central body portion, and a front section. The central body portion is joined to the end wall at its one end and to the front section at its other end. The central body portion is defined by upper and lower side walls. The front section has an opening which is located opposite the end wall for receiving the shell buckle latch member and has inner retaining surfaces. The lower side wall of the central body portion includes a pair of resilient arch members which extends from the opposite sides thereof so as to form a C-shaped section. The pair of arch members have side guard members which are separated from the end wall and the front section by arcuate slots. The guard members have actuating members formed on their inner surfaces.

The shell buckle latch member includes a base, a central member connected to the base member, and a pair of resilient arms extending from the distal end of the central member and towards the base member. The resilient arms have locking projections for releasably engaging the inner retaining surfaces of the body member. The side guard members are resiliently flexible toward each other in a curling action to form the C-shaped section with a smaller radius and to cause the actuating members to urge the arms to flex resiliently toward each other so as to disengage the locking projections from the inner retaining surfaces.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein:

FIG. 4 is a cross-sectional view, taken along the lines 4—4 of FIG. 1;

FIG. 5 is a plan view of the body member of the shell buckle of FIG. 2;

FIG. 6 is a plan view, taken from the back of FIG. 5;

FIG. 7 is a plan view of the latch member of the shell buckle of FIG. 2; and

FIG. 8 is a plan view, taken from the back of FIG. 7.

DESCRIPTION OF THE PREFERRED EMBODIMENT

Figure 1:
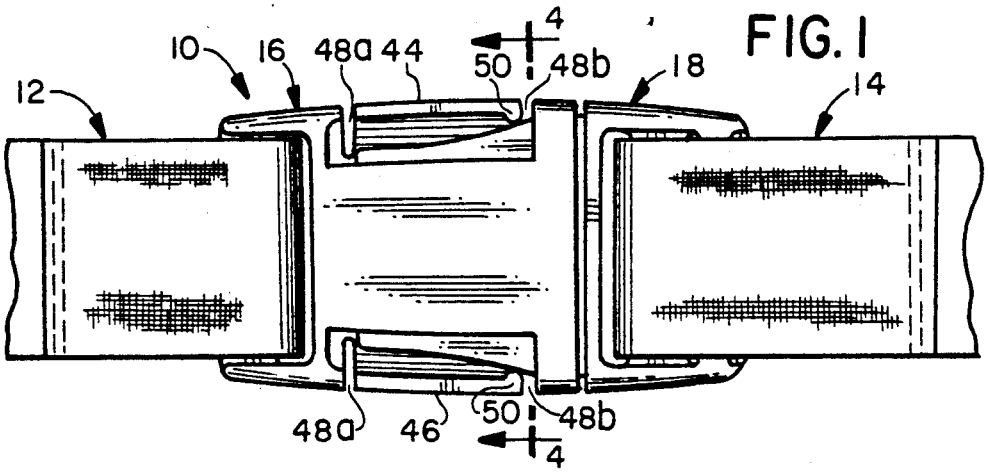
FIG. 1 is a front plan view of a shell buckle constructed in accordance with the principles of the present invention, with the shell buckle body and latch members being interconnected.

Referring now in detail to the various views of the drawings, there is illustrated a shell buckle 10 constructed in accordance with the principles of the present invention for releasably securing together a pair of ends 12 and 14 of a belt, strap or the like. The shell buckle 10 includes a separable co-operating receptacle or shell buckle body member 16 and a shell buckle latch member 18 which is adapted for receipt in the body member 16. Both the body member and the latch member are preferably made of a resilient plastic material, such as nylon and the like, which can be formed by insert injection molding equipment. The body member 16 and the latch member 18 each include co-operating or intercoupling means for releasably interengaging the latch and body members.

The shell buckle member 16 is comprised of a rectangularly-shaped central body portion 20 defined by opposed upper and lower side walls 22, 24 which are joined at its one end to an end wall 26 and is joined to a front section 28 on its other end. The front section 28 has an opening 30 leading into the interior of the central body portion 20 for receiving the shell buckle latch member 18. Extending transversely and rearwardly from the opposite ends of the end wall 26 are a pair of parallel spaced-apart stems 32, 34 which are joined together at their distal ends by a connecting cross-bar member 36. Between the cross-member bar member 36 and the rear surface of the end wall 26, there is formed a slot 38 through which the end 12 of the strap may be threaded and secured to itself by any well known means, such as by stitching.

On the opposite sides of the lower side wall 24 of the body portion 20, there are formed integrally therewith and extending therefrom a pair of resilient arch members 40, 42 having side guard members 44, 46 so as to form a C-shaped section. The resilient arch members with the side guard members are formed of a reduced thickness so as to facilitate its flexibility, as will be explained hereinafter. As can be seen from FIGS. 5 and 6, each of the side guard members 44, 46 are separated from the respective end wall 26 and front section 28 by a pair of arcuate slots **48*a* and 48*b*. Each of the guard members has formed on its inner surface an inwardly extending actuating tab 50 disposed adjacent the arcuate slot 48*b*. In the intermediate area of the inner surface of the upper side wall 22 of the central body portion 20, there is provided a longitudinally extending rib member 52 which serves as a guide member to facilitate alignment and insertion of the shell buckle latch member 18. Further, the rib member 52 functions to prevent incorrect orientation of the latch member 18 to the body member 16** during insertion.

The front section 28 further has relatively narrower top and bottom walls 54, 56 which are connected together by opposed relatively narrower upper and lower side walls 58, 60. The middle portion of inner edges of the upper side wall 58 is formed integrally with the upper side wall 22 of the central body portion 20. The lower side wall 60 is constructed of an arcuate shape which is used to assist in preventing the incorrect orientation of latch member 18 and the body member 16. The intercoupling means of the shell buckle body member 16 is defined by inner retaining surfaces **62*a*, 62*b* of the respective top and bottom walls 54, 56**.

The shell buckle latch member 18 includes a relative rigid central member 64 which is connected to a base member 66. Extending from the distal end of the central member 64 remote from the base member 66 are a pair of opposed resilient arms 68, 70 which are reversely bent towards the base members 66. As can best be seen from FIGS. 7 and 8, the resilient arms 68, 70 are provided with locking projections 72, 74 defining the intercoupling means of the shell buckle latch member 18. Each of the resilient arms has an inner surface 76 which is substantially perpendicular to the distal end of the central member 64 and extends between the distal end thereof to the locking projection. Further, each of the resilient arms has an outwardly sloping or inclined outer surface 78 extending between the distal end of the central member 66 and the locking projection such that the arm gradually increases in thickness in a direction from the distal end thereof to the locking projection. The locking projections are formed with a pair of abutment surfaces 80 and shoulders 82.

Figure 2:
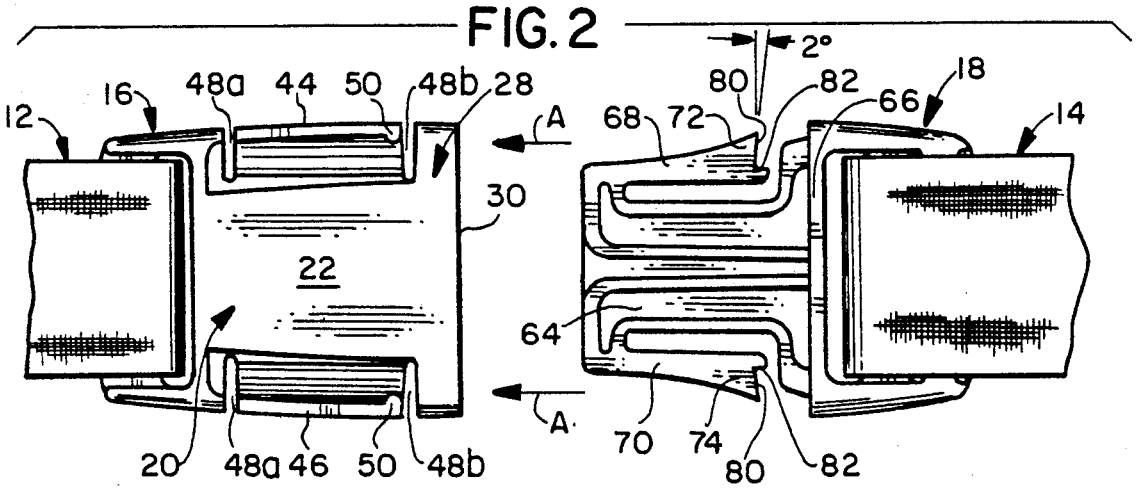
FIG. 2 is a front plan view of the shell buckle of FIG. 1, with the shell buckle body and latch members being disconnected.

It will be noted that the abutment surfaces 80, as illustrated in FIG. 2, are slightly sloping at approximately 2° from a vertical axis perpendicular to a line extending longitudinally of the central member 64. Therefore, the distances between the outer edges of the abutment surfaces 80 and the base member 66 are slightly smaller than the distances between the shoulders 82 and the base member. In this manner, the latch member 18 is prevented from being disengaged from the buckle member 16 by merely pulling in opposite directions on the latch and buckle members after they have been coupled together. In particular, such pulling on the coupled latch and buckle members will cause the resilient arms 68, 70 to flare outwardly slightly due to the abutment surfaces 80 being sloped, thereby preventing unlocking of the latch and buckle members.

In the intermediate area of the central member 64 there are provided a pair of longitudinally extending vertical strut members 84, 86 which are spaced apart so as to define a channel 88 therebetween. The strut members 84, 86 serve as guide rails for the rib member 52 on the upper side wall 22 of the central body portion 20 on the shell buckle body member 16. Extending transversely and rearwardly from opposite ends of the base member 66, are a pair of spaced-apart stems 90, 92 which are joined together at their distal ends by an end connecting-bar member 94. The end connecting-bar member 94 includes a plurality of parallel notches or grooves 96 which provide increased gripping strength for engagement with a portion of the end 14 of the strap. An intermediate connecting-bar member 98 is also provided which joins the stems 90, 92 in their substantially middle portion. As shown in FIG. 8, the intermediate connecting-bar 98 includes a plurality of narrow slits 100 which also provides increased gripping strength for another portion of the end 14 of the strap. In use, the strap end 14 is frictionally held against the end connecting-bar 94 via the notches 96 while forming a loop around the intermediate connecting bar 98 in which the slits 100 thereof engage other portions of the strap end, as shown in FIG. 1.

In accordance with the foregoing description, it can thus be seen that the shell buckle latch member 18 may be readily inserted into the opening 30 on the front section 28 of the shell buckle body member 16 wherein the sloping outer surfaces 78 are slidably engaged with the inside surfaces of the top and bottom walls 54, 56. The resilient arms 68, 70 are caused to flex inwardly toward each other as the latch member 18 is moved in the direction of arrows A (FIG. 2) for insertion into the body member 16. Further advancement of the resilient arms will cause the locking projections 72, 74 to be moved past the inner retaining surfaces **62*a*, 62*b* of the top and bottom walls 54, 56, thereby permitting the resilient arms to spring or snap back to their original position illustrated in FIGS. 1 and 4. As a result, the abutment surfaces 80 and shoulders 82 are brought into engagement with the respective retaining surfaces 62*a*, 62*b* so as to lock the shell buckle body and latch members 16 and 18 together. During such insertion, it should be noted that the rib member 52 will slidably engage in the channel 88 between the strut members 84, 86** so as to maintain alignment and correct orientation of the body and latch members.

Figure 3:
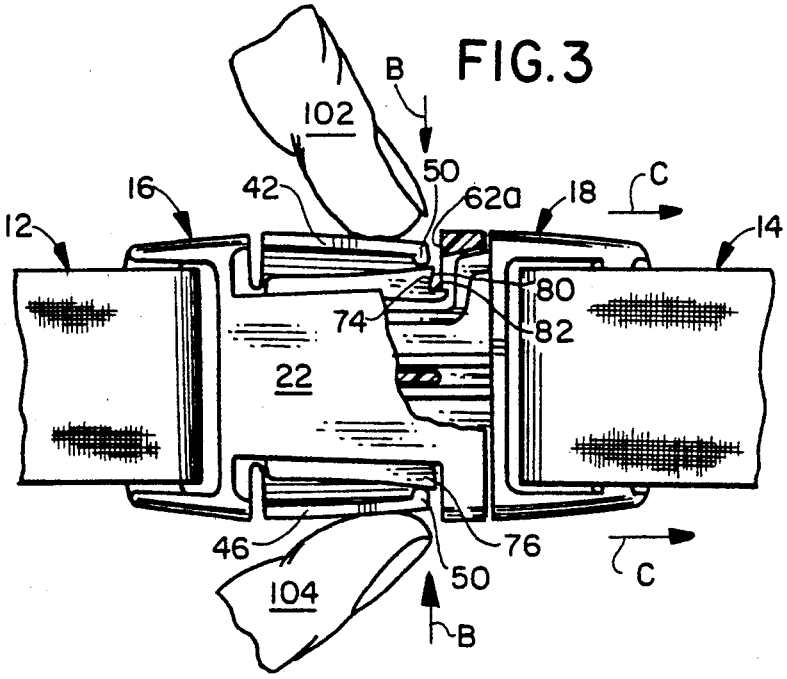
FIG. 3 is a front elevational, partly cut-away view of the shell buckle of FIG. 1, illustrating how the shell buckle body and latch members may be disconnected.

In view of the foregoing description and with particular reference to FIG. 3 of the drawings, the method of unlocking the locking projections 72, 74 from the inner retaining surfaces **62*a*, 62*b* so as to permit disengagement or removal of the shell buckle latch member 18 from the shell buckle body member 16 will become apparent. As illustrated by the fingers 102, 104, the C-shaped section consisting of the lower side 24 of the body portion 20 and the resilient arch members 40,42 with the side guard members 42,46, which is curled around the resilient arms 68,70, is moved with a curling action so as to form a tighter C-shaped section or a C-shaped section having a smaller radius. As a consequence, the upper and lower actuating tabs 50 on the respective guard members will be moved inwardly or forced directly in a vertical direction of arrows B rather than being actuated with a pivotal movement as in the prior art, and the locking projections 74,76 will be urged directly toward each other against the resiliency of the arms 68, 70**.

This curling motion (in the direction of arrows B) will cause the abutment surfaces 80 and the shoulders 82 to become disengaged from the retaining surfaces **62*a*, 62*b*, thereby allowing the latch member 18 to be readily removed from the body member 16 by moving the same in the direction of arrows C. It will be recalled that the resilient arch members with the side guard members are made of a reduce thickness than the thickness of the central body portion 20 so that less pressure is required during disengagement which also serves to facilitate a quick-release of the latch member 18 from the body member 16**.

From the foregoing detailed description, it can thus be seen that the present invention provides an improved shell buckle for releasably securing together a pair of ends of a belt, strap or the like. The shell buckle is formed of a shell buckle body member and a shell buckle latch member. The shell buckle body member includes a pair of resilient arch members extending the sides of a central portion of the body member so as to form a C-shaped section for facilitating quick-release of the latch member from the body member.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. A shell buckle comprising:

a shell buckle body member;

a shell buckle latch member;

said shell buckle body member being formed of an end wall, a central body portion, and a front section, said central body portion being joined to said end wall at its one end and to said front section at its other end, said central body portion being defined by upper and lower side walls, said front section having an opening which is located opposite said end wall for receiving said shell buckle latch member and having inner retaining surfaces;

said lower side wall of said central body portion including a pair of resilient arch members extending from opposite sides thereof so as to form a C-shaped section, said pair of arch members having side guard members which are separated from said end wall and said front section by arcuate slots, said guard members having actuating members formed on its inner surfaces;

said shell body latch member including a base member, a central member connected to said base member with an end distal to the connection of said central member to said base member, and a pair of resilient arms extending from distal end of said central member and towards said base member, said resilient arms having locking projections for releasably engaging said inner retaining surfaces of said body member; and said side guard members being resiliently flexible toward each other in a curling action to form the C-shaped section with a smaller radius and to cause said actuating members to urge said arms to flex resiliently toward each other so as to disengage said locking projections from said inner retaining surfaces.

2. A shell buckle as claimed in claim 1, wherein said guard members are formed of a reduced thickness so as to facilitate a quick-release of said shell buckle latch member from said shell buckle body member.

3. A shell buckle as claimed in claim 1, wherein an interior surface of said upper side wall includes a longitudinally extending rib member which serves as a guide member.

4. A shell buckle as claimed in claim 3, wherein said central member of said latch member includes a pair of spaced-apart strut members forming a channel therebetween, said strut members serving as guide rails for said rib member so as to facilitate alignment and proper orientation of said latch member to said body member.

5. A shell buckle as claimed in claim 4, wherein said front section includes relatively narrower upper and lower side walls, one of said narrower upper and lower side walls having an arcuate shape so as to assist in the proper orientation of said latch member to said body member.

6. A shell buckle as claimed in claim 1, wherein said actuating members is comprised of inwardly extending tabs for engagement with said locking projections to force said locking projections away from said retaining surfaces.

7. A shell buckle as claimed in claim 1, wherein said latch member and said body member are made of a plastic material by injection molding.

8. A shell buckle as claimed in claim 1, wherein said latch member and said body member each includes means for connecting an end of a strap to be attached thereto.

9. A shell buckle as claimed in claim 1, wherein said central body portion of said shell buckle body member is generally rectangular in shape.

10. A shell buckle as claimed in claim 1, wherein said locking projections are formed with slightly sloping surfaces to cause said resilient arms to flare outwardly so as to prevent unlocking of said latch and buckle members.

11. A shell buckle for releasably securing together a pair of ends of a belt, strap or the like comprising:

a shell buckle latch member having a pair of opposed resilient arms being movable toward and away from each other;

a shell buckle body member including a central body portion having a pair of resilient arch members extending from the opposite sides thereof so as to form a C-shaped section having a C-shaped cross section lying in a plane perpendicular to a direction of insertion of said latch member into said central body portion;

said resilient arms being receivable in said central body portion and releasably interengaging with means of said shell buckle body member to connect said latch member and body member together; and said resilient arch member including opposite side guard members being movable inwardly relative to each other in a curling action to form the C-shaped section with a smaller radius and to cause inward movement of said resilient arms on said latch member to disengage said latch member from said body member.

12. A shell buckle as claimed in claim 11, wherein said guard members are formed of a reduced thickness so as to facilitate a quick-release of said shell buckle latch member from said shell buckle body member.

13. A shell buckle as claimed in claim 11, wherein said latch member and said body member are made of a plastic material by injection molding.

14. A shell buckle as claimed in claim 11, wherein said latch member and said body member each includes means for connecting and end of a strap to be attached thereto.

15. A shell buckle as claimed in claim 11, wherein said central body portion of said shell buckle body member is generally rectangular in shape.

16. A shell buckle as claimed in claim 11, wherein said opposed resilient arms are formed with locking projections having slightly sloping surfaces to cause said opposed resilient arms to flare outwardly, thereby preventing disengagement of said latch member from said body member.

* * * * *